US006457692B1

(12) United States Patent
Gohl, Jr.

(10) Patent No.: US 6,457,692 B1
(45) Date of Patent: Oct. 1, 2002

(54) HANGER BRACKET FOR INSTALLING AND SUPPORTING SUSPENDED EQUIPMENT

(75) Inventor: Wayne F. Gohl, Jr., Yakima, WA (US)

(73) Assignee: Northwest Refrigeration Contractors, Inc., Yakima, WA (US)

( * ) Notice: Subject to any disclaimer, the term of this patent is extended or adjusted under 35 U.S.C. 154(b) by 0 days.

(21) Appl. No.: 09/690,369

(22) Filed: Oct. 16, 2000

(51) Int. Cl.[7] ..... A47H 1/10
(52) U.S. Cl. ..... 248/317; 248/301
(58) Field of Search ..... 248/317, 300, 248/301, 304, 322, 214, 215

(56) References Cited

U.S. PATENT DOCUMENTS

| | | | | | |
|---|---|---|---|---|---|
| 2,057,092 | A | | 10/1936 | Geib | |
| 2,767,032 | A | | 10/1956 | Mitchell | |
| 2,869,201 | A | * | 1/1959 | Wolff | 248/214 |
| 2,957,670 | A | | 10/1960 | Wendl et al. | |
| 3,147,866 | A | | 9/1964 | Jones et al. | 211/126 |
| 3,465,893 | A | | 9/1969 | Kinney | 211/86 |
| 3,735,951 | A | | 5/1973 | Reed | 248/340 |
| 4,856,744 | A | | 8/1989 | Frankel | 248/215 |
| 4,957,185 | A | | 9/1990 | Courchesne et al. | 182/150 |
| 5,039,039 | A | | 8/1991 | Schaffer | 248/59 |
| 5,174,539 | A | | 12/1992 | Leonard | 248/558 |
| 5,271,192 | A | * | 12/1993 | Nothum, Sr. et al. | 248/48.2 |
| 5,279,452 | A | * | 1/1994 | Huynh | 248/215 X |
| 5,695,073 | A | | 12/1997 | Klein et al. | 211/35 |
| 5,855,279 | A | | 1/1999 | Klein et al. | 211/35 |
| 5,897,086 | A | * | 4/1999 | Condon | 248/300 X |
| 6,202,969 | B1 | * | 3/2001 | Orr | 248/301 |

* cited by examiner

*Primary Examiner*—Ramon O. Ramirez
(74) *Attorney, Agent, or Firm*—Stratton Ballew PLLC

(57) ABSTRACT

A hanger bracket for supporting suspended equipment from a support rail. The hanger bracket includes a rail cap adjoined to a side bar. The rail cap also includes a lip parallel to the sidebar. The rail cap rests on the top surface of the support rail. The lip adjoins to the rail cap at an opposite end of the rail cap from the sidebar. The hanger bracket, with the sidebar, the rail cap and the lip, has an inverted "J" shape. The sidebar of the hanger bracket mounts onto an element of the suspended equipment, so that the rail cap rests on a top surface of the support rail. A plurality of hanger brackets can support the equipment element on the support rail. The hanger bracket is first mounted to the equipment element of the overhead equipment, which is then lifted to raise the rail cap above a support rail. The equipment element is then shifted, to position the rail cap over the support rail. The equipment element is finally lowered to contact the rail cap with the top surface of the support rail. The hanger bracket can slide along the support rail to reposition the equipment element. The hanger bracket is intrinsically safe for hanging heavy equipment from a ceiling or roof structure as it utilizes the weight of the suspended equipment element to supplement the holding force of the hanger bracket, allowing the performance of several installation steps at the floor level.

10 Claims, 7 Drawing Sheets

HANGER BRACKET FOR INSTALLING AND SUPPORTING SUSPENDED EQUIPMENT

TECHNICAL FIELD

The invention relates to a method and apparatus for a hanger bracket, and more particularly to a method for installing and supporting suspended equipment with the hanger bracket.

BACKGROUND OF THE INVENTION

The overhead suspension of heavy equipment presents problems both in the installation of such equipment and in the continued safe support of the suspended equipment. Heavy equipment is often suspended from the underside of roofs or similar overhead structures in buildings or facilities, such as warehouses, auditoriums, garages and aircraft hangers. The function of this overhead equipment may be for such purposes as exhaust, ventilation, heating, cooling, electrical, or lighting, to name a few.

The installation of heavy overhead equipment is conventionally performed with the aid of hydraulic lifts or cranes that hoist the equipment to its installed location at the required height above the floor surface. Skilled construction technicians employ conventional hangers, bolts or straps to connect elements of the equipment to the supportive structure of the building or facility.

U.S. Pat. No. 5,039,039 to Schaffer, shows an L-shaped, equipment supportive hanger bracket that attaches to a rod, which is suspended from a concrete ceiling structure. The bracket of Schaffer '039 requires a tight, friction connection between a series of U-bolts and an L-shaped bracket to grip the suspended rod. If the equipment load, borne by the L-shaped bracket, is heavy enough to overcome the gripping power of the U-bolts, the L-shaped bracket can slip off of the rod, and the equipment will fall. A hanger bracket is needed that provides an intrinsically safe means for hanging heavy equipment from a ceiling or roof structure.

Again, in regards to Schaffer '039, the supported equipment, shown as pipes or conduit, must be installed after the installation of the hanger bracket and U-bolts. When the equipment is placed on or attach to the hanger, this operation is conventionally performed at the final height of the equipment. Work performed well above the floor, up against the roof structure, requires a high level of safety-related precaution and so is performed slowly and at some risk. It would therefore, be desirable to reduce the difficulties and risk associated with the installation of elevated or overhead equipment by somehow performing some of the installation operation at floor level.

SUMMARY OF INVENTION

The present invention provides a hanger bracket for supporting suspended equipment from a support rail. The hanger bracket includes a rail cap adjoined to a side bar. The side bar adjoins to the rail cap to form a substantially inverted "L" shape. The rail cap also includes a lip that is substantially parallel to the sidebar. The lip adjoins to the rail cap at an opposite end of the rail cap from the sidebar. The hanger bracket, with the sidebar, the rail cap and the lip, has substantially an inverted "J" shape.

Specifically, the rail cap includes a first cap end and a second cap end, and the side bar has a top sidebar end and a bottom sidebar end. The first cap end adjoins with the side bar at the top sidebar end. The lip adjoins to the rail cap proximate the second end of the rail cap, the lip being substantially parallel to and substantially co-directional with the side bar.

The sidebar of the hanger bracket mounts onto an element of the suspended equipment, so that the rail cap rests on a top surface of the support rail. The rail cap further includes a cap face. The lip and the sidebar extend from the cap face, and the cap face can rest on the top surface of the support rail. The side bar and the rail cap can comprise a contiguous piece of a metal material. Most preferably, a plurality of hanger brackets support the equipment element on the support rail. The equipment element has a length, along which each one of the plurality of hangers are positioned.

The rail cap of the hanger is load bearing in that it bears the weight or load of the equipment element upon the support rail. The side bar of the hanger mounts onto the equipment element, and the rail cap is able to rest on the top surface of a support rail.

The method of the present invention includes installing overhead equipment with the hanger bracket. The hanger bracket is first mounted to the equipment element of the overhead equipment. The equipment element is then lifted to raise the rail cap above a support rail. The equipment element is then shifted, to position the rail cap over the support rail. When the equipment element is in position with the rail cap over the support rail, the equipment element is lowered to contact the rail cap with the top surface of the support rail.

Additionally, the method of the invention can include sliding the hanger bracket along the support rail to reposition the equipment element. The equipment element can be first positioned at a point along the support rail where it is most easily raised or lifted onto the support rail, and then moved by sliding, which can be either through pulling or pushing the equipment element to a final position on the support rail.

The present invention provides a hanger bracket that provides an intrinsically safe means for hanging heavy equipment from a ceiling or roof structure. The hanger bracket of the present invention utilizes the weight of the suspended equipment element to supplement the holding force of the hanger bracket.

Additionally, the hanger bracket of the of the present invention reduces the difficulties and risks associated with the installation of elevated or overhead equipment. The structural features of the hanger bracket of the present invention provides for the performance of several installation operation steps at the floor level. In the preferred method of the present invention, the hanger bracket is attached to the equipment element while the equipment is at floor level. The equipment element is then lifted to the final position with a minimum of further installation related operations performed at a high elevation off the floor.

The invention will be better understood by reference to the following detailed description taken in conjunction with the accompanying drawings.

DETAILED DESCRIPTION OF SPECIFIC EMBODIMENTS

Figure 1:
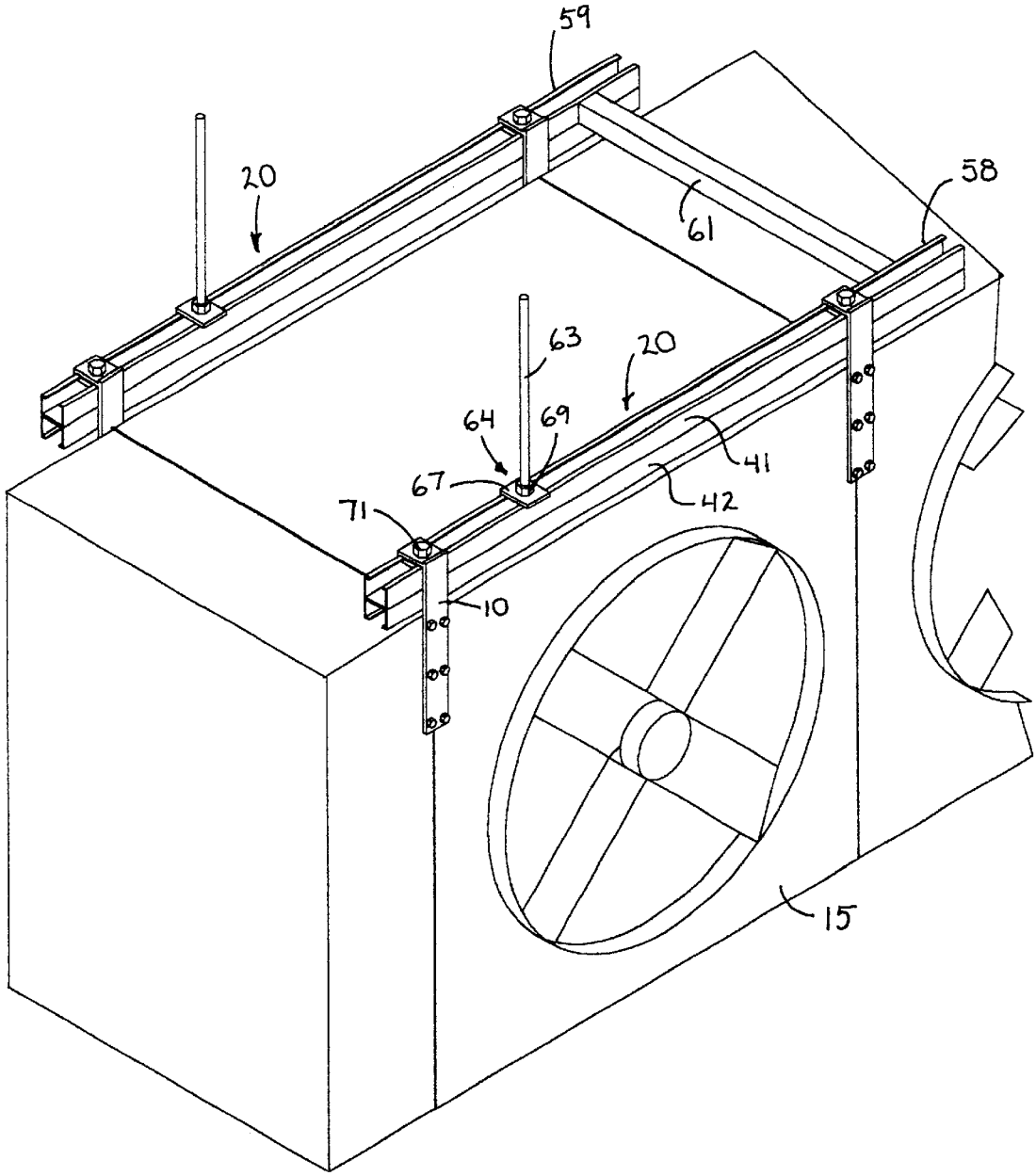
FIG. 1 is a perspective view of a suspended equipment element supported with a hanger bracket, according to an embodiment of the invention.
Figure 4:
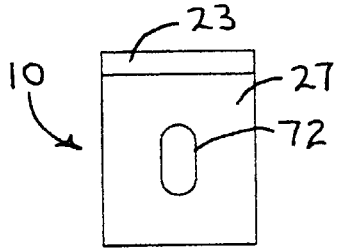
FIG. 4 is a rear view of a hanger bracket, according to an embodiment of the invention.

The invention provides hanger bracket and a method for installing and supporting suspended equipment with the hanger bracket. The hanger bracket 10 is shown in FIGS. 1 through 7, 9 and 10. FIG. 1 shows an equipment element 15 suspended from a support rail 20, which typifies an installation employing the hanger bracket of the present invention.

Figure 2:
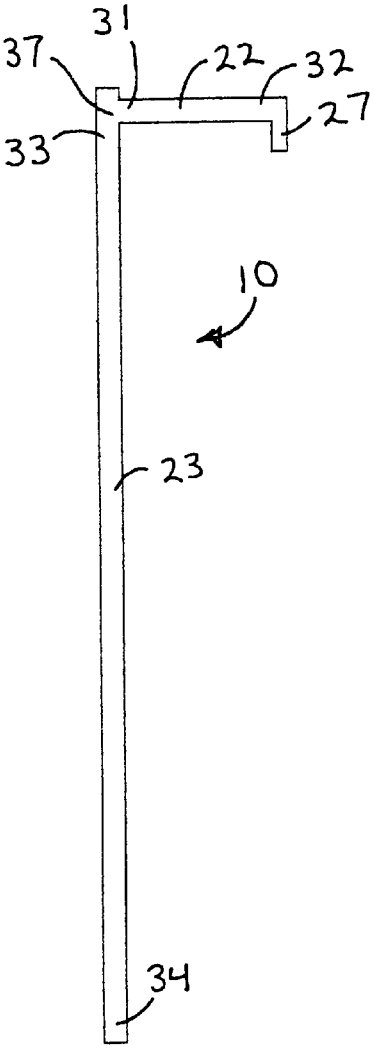
FIG. 2 is a side view of a hanger bracket, according to an embodiment of the invention.
Figure 5:
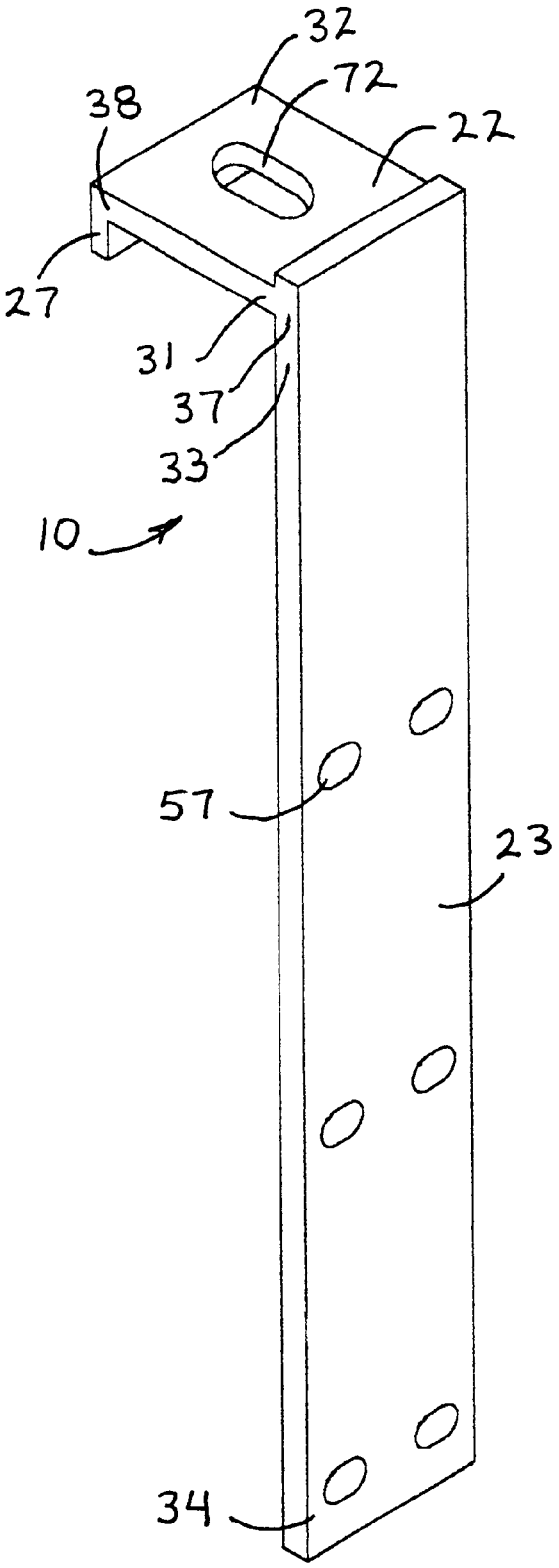
FIG. 5 is a top view of a hanger bracket, according to an embodiment of the invention.

As detailed in FIGS. 2 and 5, the hanger bracket 10 the hanger bracket includes a rail cap 22 adjoined to a side bar 23. The rail cap and the side bar adjoin to the rail cap, approximately at a right angle to form a substantially inverted "L" shape.

Figure 6:
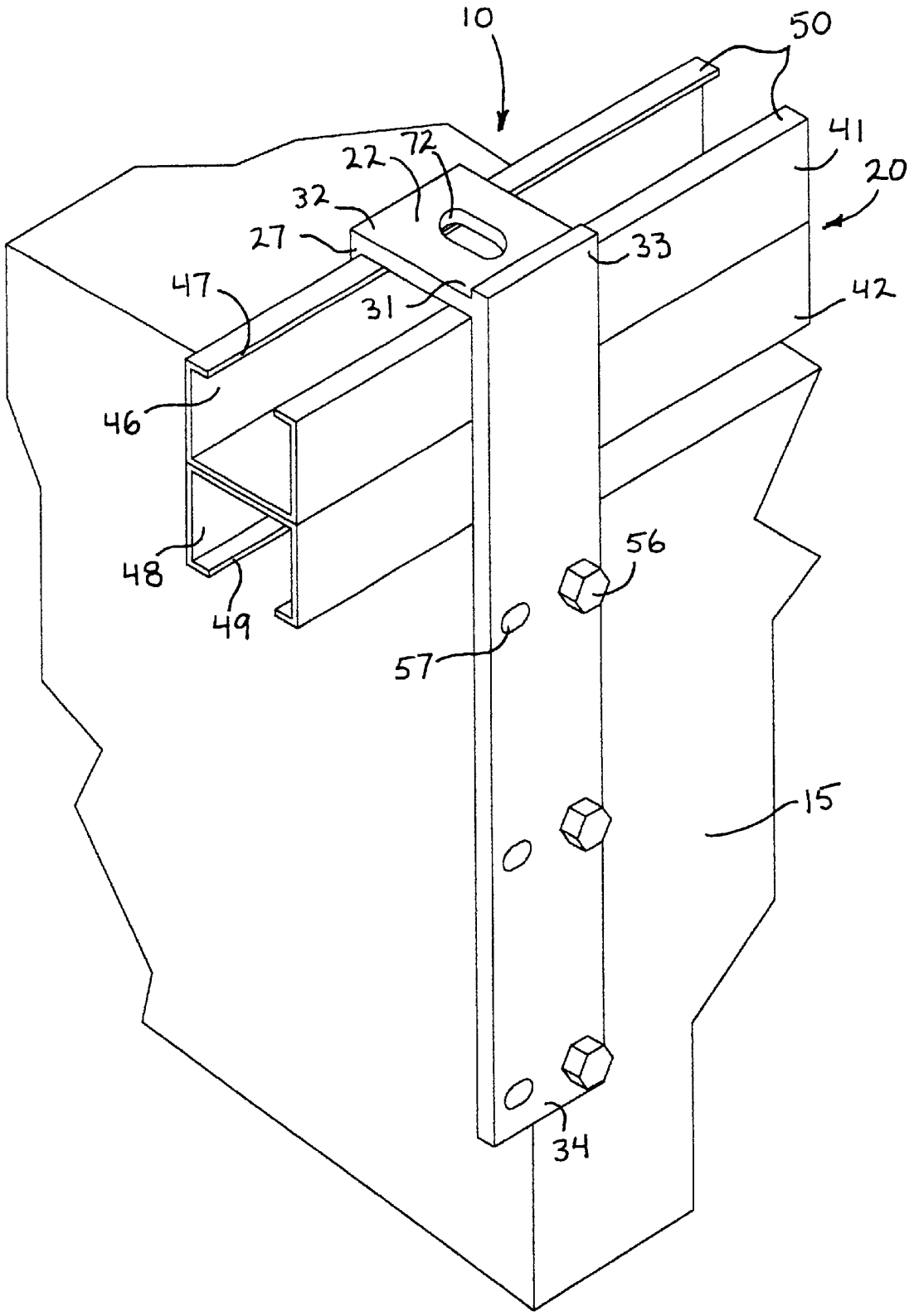
FIG. 6 is a perspective view of a suspended equipment element supported with a hanger bracket, according to an embodiment of the invention.
Figure 7:
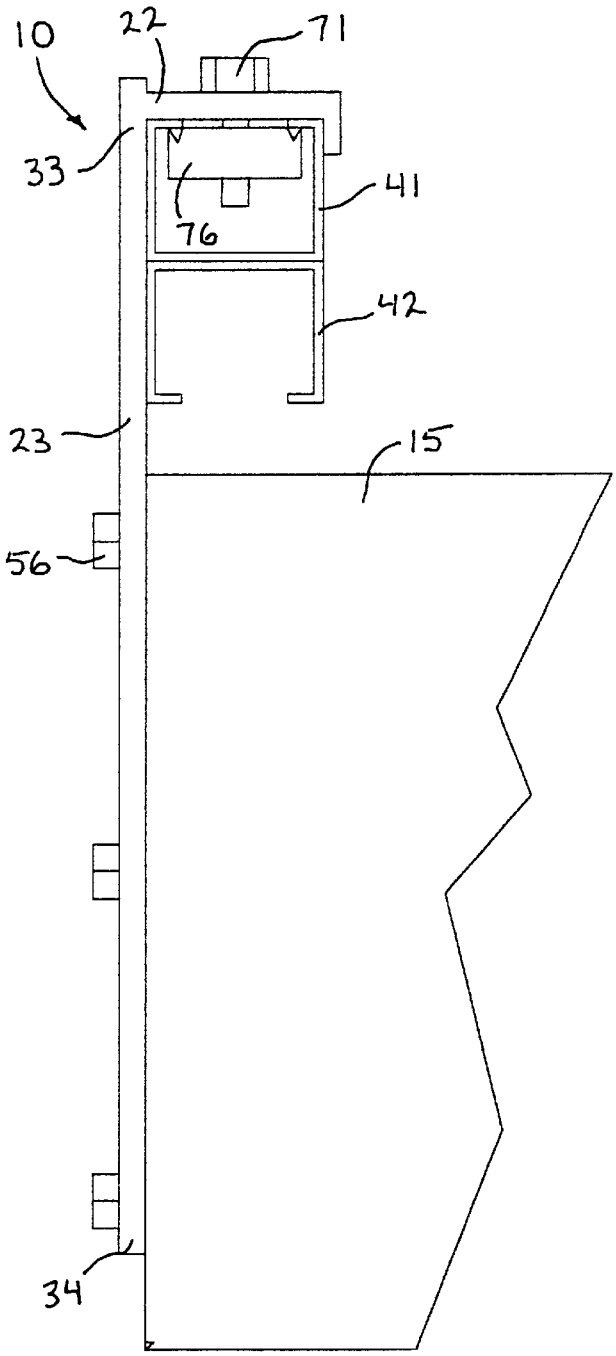
FIG. 7 is a side view of a suspended equipment element supported with a hanger bracket, according to an embodiment of the invention.
Figure 8:
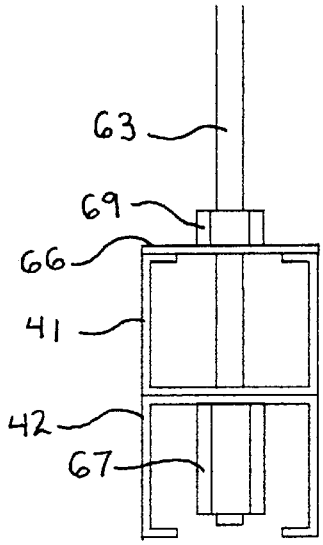
FIG. 8 is a side view of a support rail suspended from a hanger rod, according to an embodiment of the invention.
Figure 9:
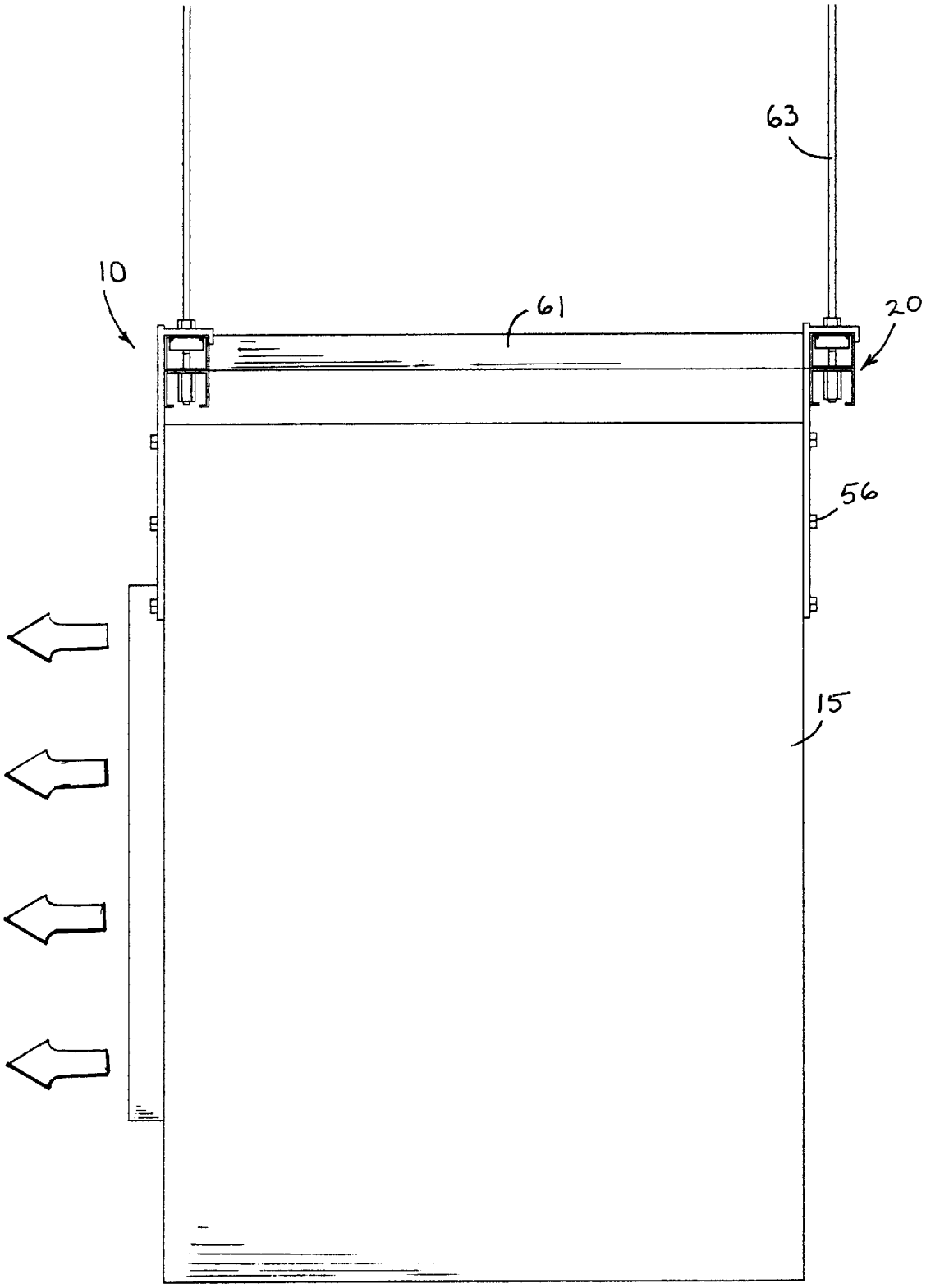
FIG. 9 is a side view of a suspended equipment element supported with a hanger bracket, according to an embodiment of the invention.

As further detailed in FIG. 6, to achieve a secure mounting to the equipment element 15, the hanger bracket 10 is preferably installed with the sidebar 23 in a substantially vertical position, with the rail cap 22 at the top of the hanger bracket. The rail cap of the hanger bracket rests on the top of a support rail 20. The rail cap can also include a lip 27. The lip is shown in FIGS. 7 and 9 as extending down the support rail. The lip prevents the rail cap from moving off the support rail. The lip is substantially parallel to the sidebar, but adjoins to the rail cap at an opposite end of the rail cap from the sidebar. The sidebar, the rail cap and the lip together form substantially an inverted "J" shape.

Specifically, as shown in FIG. 2, the rail cap 22 includes a first cap end 31 and a second cap end 32. The side bar 23 has a sidebar top 33 and a sidebar bottom 34. The first cap end adjoins with the sidebar at the top sidebar end. The lip 27 adjoins to the rail cap proximate the second end of the rail cap, the lip being substantially parallel to and extending from the rail cap in substantially the same direction as the sidebar.

When the hanger bracket 10 is manufactured from a metal material, as preferred, the lip 27 and the sidebar 23 are both be welded to the rail cap 22. Alternatively, the hanger bracket can be formed from a contiguous piece of a metal material, with a first right angle bend 37 of material off of the sidebar to form the rail cap and a second right angle bend 38 of material off the rail cap to form the lip.

The support rail 20, from which the hanger bracket 10 suspends, is also preferably formed from a metal material. More preferably, the support rail is a conventional, steel channel support rail, such as a UNISTRUT® rail manufactured by Unistrut Corporation of Itasca, Ill. U.S.A. Alternatively, GlobeStrut® steel channel, manufactured by GS Metals Corporation of Pinckneyville, Ill. also includes support rail configurations that can perform well with the present invention. A preferable support rail configuration is shown in FIGS. 6 through 10 and includes a top rail 41 affixed to a bottom rail 42. In this preferred support rail configuration, the top rail includes an upper channel having an upper slot 47 that faces upward, and a lower channel 48 having a lower slot 49 that faces downward. The upper slot divides a top surface 50 of the upper rail, detailed in FIG. 6.

The rail cap 22 further includes a cap face 37. The lip 27 and the sidebar 23 extend from the cap face. The cap face rests on the top surface 50 of the support rail 42. The lip of the rail cap prevents the hanger bracket 10 from moving laterally on the support rail, while allowing the hanger bracket to move along the length of the support rail. The rail cap of the hanger is "load bearing" in that it carries the weight of the equipment element, transferring this load to the top surface of the support rail, upon which the rail cap rests.

Preferably, the metal material from which the hanger bracket is preferably fabricated of a carbon steel, and most preferably a medium carbon steel, such as SAE (Society of Automotive Engineers) "standard steel," designated as standard type "1040." Any suitable steels or alloys are considered for fabricating the hanger bracket 10 of the present invention. Factors that should be considered in the selection of the material for the hanger bracket should include tensile strength, hardness, weight, cost, manufacturing requirements, and environment of use. The environment in which the hanger bracket is employed is an important consideration because the hanger bracket is considered ideal for the suspension of heavy air handling equipment 15 that may be needed to serve under harsh conditions. An example of an equipment element that may be installed in such an adverse environment includes cooling coils installed in cold and controlled atmosphere storage. Typically, these cold storage environments exhibit high humidity and cold temperature. Additionally, some suspended equipment utilizes potentially corrosive salt brines for cooling fluids, and others circulate caustic solutions for the purpose of air scrubbing.

The hanger bracket 10 must have the ability to resist corrosion when utilized in harsh environments. Most preferably, the steel hanger bracket is "hot-dipped" in a zinc galvanizing solution, to protect it from corrosion in cold and moist atmospheres. Additionally, in a preferred embodiment of the present invention that is specifically configured to support an equipment element as shown in FIGS. 1 through 10, the sidebar 23 has a length of approximately 15.5 inches, a thickness of approximately ⅜ths of an inch, and a width of approximately 2.5 inches. In this preferred embodiment, the rail cap 22 is also approximately ⅜th of an inch thick and extends approximately 3 inches out from the sidebar to rest on the support rail 20 having an width of approximately 2 inches, and the lip 27 extends approximately 0.5 inches down from the rail cap. These dimensions are broadly exemplary, in that factors such as equipment load, support rail dimensions and hanger bracket spacing, all govern the dimensions of the hanger bracket.

Figure 3:
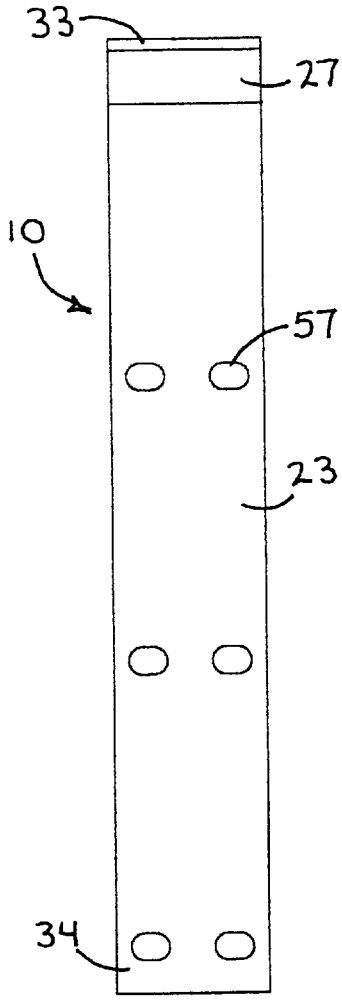
FIG. 3 is a front view of a hanger bracket, according to an embodiment of the invention.

As detailed in FIGS. 6 and 7, the hanger bracket 10 attaches to the equipment element 15, which is preferably an air handler. Alternatively, the equipment element could be any mechanical, electrical, lighting, billboard, sign, or any such element that requires suspension from a ceiling grid, roof structure or beam similar to the support rail 20. Attachment of the hanger bracket to the equipment element is preferably accomplished by the placing at least a single equipment bolt 56 through a sidebar bolt hole 57. The sidebar bolt hole penetrates through the sidebar 23 as shown in FIGS. 3, 5 and 6. The equipment bolt passes through the sidebar of the hanger bracket and threadingly attaches to the equipment element. Most preferably, a plurality of sidebar bolt holes are included in the sidebar. This plurality of sidebar bolt holes each receive an equipment bolt to mount the hanger element to the equipment element securely. Alternatively, other methods of attachment are considered within the scope of the present invention, including welding the sidebar to the equipment element.

Figure 10:
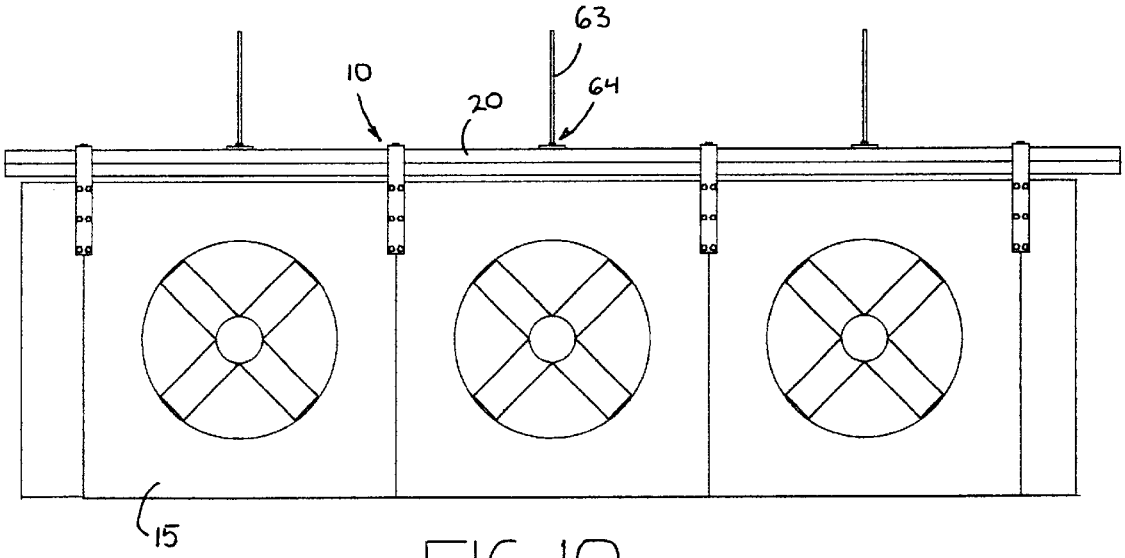
FIG. 10 is a front view of a suspended equipment element supported with a hanger bracket, according to an embodiment of the invention.

The equipment element 15 has a length, and the load bearing support rail 20 preferably runs the length of the equipment element, as shown in FIG. 10, which details the hanger bracket 10 in the installation of an air handler equipment element. As also preferred, the support rail 20 can receive a plurality of the hanger brackets. Most preferably, as shown in FIGS. 1, 9 and 10, two parallel support rails, a first support rail 58 and a second support rail 59, each approximately running the length of the equipment element. These two rails are preferably positioned near the respective front and back, or opposite sides of the equipment element. The load of the equipment element is distributed along the support rail in by the regular placement of the hanger brackets.

Additionally, a cross member 61 is preferably employed to maintain the parallel, first support rail 58 and second support rail 59 in position. Most preferably a plurality of cross members are placed at regular intervals between the first and second support rails. A hanger rod 63, as shown in FIGS. 1, 8, 9, and 10, ties to the support rails 20, and so connects the network of support rails and cross members to the structure above. The "structure above" typically includes a roof beam, a ceiling or a structural member, and the network of support rails and cross members in turn support the hanger bracket and attached equipment elements.

The hanger rod 63 is a common element utilized in a wide variety of construction and is typically a length of "all-thread," sized for the weight load of the equipment element 15 it will support. The hanger rod is received into a hanger mount 64, preferably positioned on the support rail 20. The hanger mount is a conventional attachment, typically including a top plate 66 above the top rail 41 and a hanger nut 67, which retains against the support rail from between the top rail and the bottom rail 42, as detailed in FIG. 8. The hanger nut is preferably a rod hex connector, as also detailed in FIG. 8. The hanger nut tightens the support rail to the top plate with a top nut 69 that threads onto the hanger rod above the top plate.

To prevent the hanger bracket 10 of the present invention from moving along the support rail 20 after the hanger bracket and attached equipment element are installed, the hanger bracket 10 can include a cap bolt 71. The cap bolt can be received into a cap bolt hole 72 in the rail cap 22, to lock the hanger bracket to the support rail. The cap bolt hole is shown in FIG. 6, as preferably centered over the upper channel 46 of the top rail 41. The cap bolt can be received into the cap bolt hole and threaded into a cap bolt nut 76 to tighten against the against the top rail as detailed in FIG. 7. Alternatively, the cap bolt nut can be a UNISTRUT® "spring nut," or similar type of spring loaded nut can be utilized to lock the rail cap onto the top rail. Also alternatively, the cap bolt nut can be a conventional nut that utilizes a washer or a small plate to similarly span the upper channel 46 of the top rail.

The method of the present invention provides for an overhead installation of equipment elements 15 utilizing the hanger bracket 10. With the equipment element typically resting on a ground surface, as preferred, the hanger bracket is first mounted to the equipment element of the overhead equipment. This mounting, as discussed above can include bolting the hanger bracket to the equipment element or alternatively welding it to the equipment element. The equipment element is then lifted to raise the rail cap above a support rail. Preferably the equipment element is lifted from below, with the hanger bracket extending above the equipment element. This lifting can be accomplished by a conventional forklift, or a plurality of forklifts spaced along longer equipment elements, if needed. Scissor lifts, jacks or similar lifting devices could also be utilized to lift the equipment element from below. Alternatively, the equipment element could be lifted from above, with a crane, a boom or some similar device. The crane might utilize lifting hooks on the equipment element, or alternatively the equipment element could be lifted from above with removable attachment to the cap bolt hole 72 of the rail cap.

The lifted equipment element 15 is then shifted into position below the support rail 20 to locate the rail cap 22 of the hanger bracket 10 over the support rail. This positioning requires that the equipment element be slightly offset to allow the rail cap to pass about the support rail and then into a final position with the cap face 37 of the rail cap directly above the top surface 50 of the support rail. When the equipment element is in position with the rail cap over the support rail, the equipment element is lowered to contact the rail cap with the top surface of the support rail.

Additionally, the method of the present invention can include sliding the hanger bracket 10 along the support rail 20 to reposition the equipment element 15. In this alternative, the equipment element is first positioned at a point along the support rail where it is most easily raised or lifted onto the support rail. The preferred method, above can be utilized to place the equipment element in this initial position. The equipment element is then moved, by sliding, or preferably by slightly raising the equipment element and reallocating it along the support rail. The sliding of the equipment element along the support rail can be accomplished by either pulling or pushing the equipment element, to a final or permanent position on the support rail. If the equipment element is slightly raised prior to moving it along the support rail, the equipment element is then lower, once the final position is reached, with the cap face of the hanger bracket again in direct contact with the top surface of the support rail.

The hanger bracket 10, pre-attached to the equipment element 15 according to the method of the present invention, allows the equipment element to be hung in a safe and smoothly executed operation. After the equipment element is located on the support rail 20, or as preferred, a parallel set of support rails, the plurality of hanger brackets can be repositioned along the support rails as the equipment element is placed in position. The installation method of the present invention avoids the potentially dangerous installation of individual, point by point hanger connections and supports, installed while the equipment element is temporarily suspended at a high elevation by external lifts, jacks or cranes.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

What is claimed is:

1. A hanger bracket for supporting suspended equipment from a support rail comprising:

a rail cap, rail cap including a cap bolt hole;

a side bar adjoined to the rail cap, the side bar adjoined together to form substantially an inverted L-shape;

the rail cap having a lip, the lip substantially parallel to the sidebar, the lip adjoined to the rail cap at an opposite end of the rail cap from the sidebar, the sidebar, the rail cap and the lip adjoined together to form substantially an inverted J-shape;

the sidebar of the hanger bracket mounted onto an element of the suspended equipment;

a support rail including a top surface and an upper channel, the upper channel running lengthwise along the support rail and the upper channel open to the rail cap;

the rail cap restable on a top surface of the support rail;

a cap bolt received into the cap bolt hole of the rail cap; and a cap nut threadably received onto the cap bolt to engage the top surface of the rail against the rail cap.

2. The hanger bracket of claim 1, wherein the rail cap further includes:

a cap face, the lip and the sidebar extended from the cap face, and the cap face of the rail cap restable on the top surface of the support rail, and the cap nut threadably received onto the cap bolt to engage the top surface of the rail against the cap face of the rail cap.

3. The hanger bracket of claim 1, wherein the side bar and the rail cap together comprise a contiguous piece of a metal material.

4. The hanger bracket of claim 4, wherein:

a plurality of hanger brackets support the equipment element on the support rail, the equipment element having a length, and each one of the plurality of hangers are positioned along the length of the equipment element.

5. A hanger bracket for supporting suspended equipment comprising:

a load bearing rail cap having a first cap end and a second cap end, and a cap bolt hole a side bar having a top sidebar end and a bottom sidebar end, the first cap end adjoined to the top sidebar end;

a lip adjoined to the rail cap proximate the second end of the rail cap, the lip substantially parallel to and substantially co-directional with the side bar;

a support rail including a top surface and an upper channel, the upper channel running lengthwise along the support rail and the upper channel open to the rail cap;

a cap bolt received into the cap bolt hole of the rail cap;

a cap nut received into the upper channel, and the cap nut threadably received onto the cap bolt to engage the top surface of the rail; and the side bar of the hanger mounted onto an equipment element, the hanger bracket for bearing the load of the equipment element on the support rail.

6. The hanger bracket of claim 5, wherein the side bar and the rail cap together comprise a contiguous piece of a metal material.

7. The hanger bracket of claim 5, wherein:

a plurality of hanger brackets support the equipment element on the support rail, the equipment element having a length, and each one of the plurality of hangers positioned along the length of the equipment element.

8. A method for installing overhead equipment with a hanger bracket comprising the steps of:

a) mounting the hanger bracket to an equipment element of the overhead equipment, the hanger bracket including a rail cap, the rail cap including a rail cap bolt hole a side bar adjoined to the rail cap, the side bar adjoined together to form substantially an inverted L-shape, the rail cap having a lip, the lip substantially parallel to the sidebar, the lip adjoined to the rail cap at an opposite end of the rail cap from the sidebar, the sidebar, and the rail cap and the lip adjoined together to form substantially an inverted J-shape;

b) lifting the equipment element to raise the rail cap above a support rail, the support rail including a top surface and an upper channel, the upper channel running lengthwise along the support rail and the upper channel open to the rail cap;

c) shifting the equipment element to position the rail cap over the support rail; and d) lowering the equipment element to contact the rail cap with a top surface of the support rail;

e) inserting a cap bolt into the cap bolt hole of the rail cap;

f) inserting a cap nut into the upper channel; and g) threading the cap nut onto the cap bolt to engage the top surface of the rail between the cap nut and the rail cap.

9. The method of claim 8 wherein the step of lowering the equipment element to contact the rail cap with a top surface of the support rail further includes the steps of:

d1) shifting the equipment element to position a cap face of the rail cap over the support rail, the cap face comprising a surface of the rail cap from which the lip and the sidebar extend, and the cap face of the rail cap restable on the top surface of the support rail; and d2) lowering the equipment element to contact the cap face of the rail cap with the top surface of the support rail.

10. The method of claim 9 further including the steps of:

h) loosening the cap nut on the cap bolt to disengage the top surface of the rail between the cap nut and the rail cap; and i) sliding the hanger bracket along the support rail to reposition the equipment element.

* * * * *